US012037656B2

(12) United States Patent
Lee et al.

(10) Patent No.: US 12,037,656 B2
(45) **Date of Patent: *Jul. 16, 2024**

(54) HIGH STRENGTH STEEL SHEET HAVING EXCELLENT DUCTILITY AND WORKABILITY, AND METHOD FOR MANUFACTURING SAME

(71) Applicant: POSCO, Pohang-si (KR)

(72) Inventors: Jae-Hoon Lee, Gwangyang-si (KR); Sang-Ho Han, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 160 days.

This patent is subject to a terminal disclaimer.

(21) Appl. No.: 17/297,733

(22) PCT Filed: Jul. 15, 2019

(86) PCT No.: PCT/KR2019/008695
§ 371 (c)(1),
(2) Date: May 27, 2021

(87) PCT Pub. No.: WO2020/130257
PCT Pub. Date: Jun. 25, 2020

(65) Prior Publication Data

US 2022/0042130 A1 Feb. 10, 2022

(30) Foreign Application Priority Data

Dec. 18, 2018 (KR) ..... 10-2018-0163899

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/34*** | (2006.01) |
| ***C22C 38/38*** | (2006.01) |
| ***C22C 38/60*** | (2006.01) |

(52) U.S. Cl.

CPC ..... *C21D 9/46* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/06* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/34* (2013.01); *C22C 38/38* (2013.01); *C22C 38/60* (2013.01); *C21D 2211/001* (2013.01); *C21D 2211/002* (2013.01); *C21D 2211/008* (2013.01)

(58) Field of Classification Search

CPC ... C21D 1/19; C21D 1/20; C21D 1/22; C21D 2211/001; C21D 2211/002; C21D 2211/005; C21D 2211/008; C21D 6/002; C21D 6/005; C21D 6/008; C21D 8/02; C21D 8/0205; C21D 8/0226; C21D 8/0236; C21D 8/0263; C21D 8/0273; C21D 8/04; C21D 8/0426; C21D 8/0436; C21D 8/0473; C21D 9/46; C22C 38/00; C22C 38/001; C22C 38/002; C22C 38/005; C22C 38/008; C22C 38/02; C22C 38/04; C22C 38/06; C22C 38/22; C22C 38/24; C22C 38/26; C22C 38/28; C22C 38/30; C22C 38/32; C22C 38/34; C22C 38/38; C22C 38/60

See application file for complete search history.

(56) References Cited

U.S. PATENT DOCUMENTS

| | | | | |
|---|---|---|---|---|
| 2007/0190353 | A1 | 8/2007 | Taniguchi et al. | |
| 2011/0139315 | A1 | 6/2011 | Nakagaito et al. | |
| 2011/0146852 | A1* | 6/2011 | Matsuda | C21D 1/19 148/333 |
| 2011/0162762 | A1 | 7/2011 | Matsuda et al. | |
| 2011/0198002 | A1 | 8/2011 | Nakagaito et al. | |
| 2014/0050941 | A1 | 2/2014 | Kawasaki et al. | |
| 2014/0170439 | A1 | 6/2014 | Allain et al. | |
| 2014/0242414 | A1 | 8/2014 | Minami et al. | |

(Continued)

FOREIGN PATENT DOCUMENTS

| | | |
|---|---|---|
| CA | 3035786 | 3/2018 |
| CA | 3047690 | 6/2018 |

(Continued)

OTHER PUBLICATIONS

International Search Report—PCT/KR2019/008695 dated Oct. 23, 2019.

(Continued)

*Primary Examiner* — Jenny R Wu

(74) *Attorney, Agent, or Firm* — CANTOR COLBURN LLP

(57) ABSTRACT

Provided is a steel sheet that can be used for automobile parts or the like, and relates to a steel sheet having an excellent balance of strength and ductility, and excellent workability, and a method for manufacturing same.

11 Claims, No Drawings

(56) References Cited

U.S. PATENT DOCUMENTS

| | | | |
|---|---|---|---|
| 2017/0051378 | A1 | 2/2017 | Lee et al. |
| 2017/0298466 | A1 | 10/2017 | Zhu et al. |
| 2017/0369974 | A1 | 12/2017 | Kim et al. |
| 2018/0298462 | A1 | 10/2018 | Sano et al. |
| 2019/0003009 | A1 | 1/2019 | Kawata et al. |
| 2019/0211427 | A1 | 7/2019 | Sano et al. |
| 2019/0330721 | A1 | 10/2019 | Hayashi et al. |
| 2020/0190619 | A1 | 6/2020 | Natsumeda et al. |
| 2021/0123122 | A1 | 4/2021 | Yokoyama et al. |

FOREIGN PATENT DOCUMENTS

| | | |
|---|---|---|
| CA | 3047945 | 7/2018 |
| CN | 101568660 | 10/2009 |
| CN | 107002207 | 8/2017 |
| CN | 107075649 | 8/2017 |
| EP | 2325346 | 5/2011 |
| EP | 2546375 | 1/2013 |
| EP | 3101147 | 12/2016 |
| JP | 2009019258 | 1/2009 |
| JP | 2009209450 | 9/2009 |
| JP | 2010090475 | 4/2010 |
| JP | 2017053001 | 3/2017 |
| JP | 6123966 | 5/2017 |
| JP | 2017214648 | 12/2017 |
| KR | 20060118602 | 11/2006 |
| KR | 20100092503 | 8/2010 |
| KR | 20110039395 | 4/2011 |
| KR | 20110042369 | 4/2011 |
| KR | 20140012167 | 1/2014 |
| KR | 20140043156 | 4/2014 |
| KR | 20180016518 | 2/2018 |
| WO | 2012147898 | 11/2012 |
| WO | WO2017164346 | 9/2017 |
| WO | 2018055695 | 3/2018 |
| WO | 2018221307 | 12/2018 |
| WO | 2019187090 | 10/2019 |

OTHER PUBLICATIONS

European Search Report—European Application No. 19900121.5 issued on Sep. 13, 2021, citing EP 2325346, CA 3047690, CA 3047945, EP 3101147, and CA 3035786.

Chinese Office Action—Chinese Application No. 201980064857.7 issued on Apr. 29, 2022, citing WO 2018/221307, CN 107075649, CN 107002207, and CN 101568660.

Japanese Office Action—Japanese Application No. 2021-535132 issued on Jul. 5, 2022, citing JP 2009-209450, JP 2 2010-090475, JP 2017-053001, WO 2019/187090, and US 2017/0298466.

* cited by examiner

HIGH STRENGTH STEEL SHEET HAVING EXCELLENT DUCTILITY AND WORKABILITY, AND METHOD FOR MANUFACTURING SAME

TECHNICAL FIELD

The present disclosure relates to a steel sheet used for automobile parts or the like, and more particularly, to a steel sheet having excellent ductility and workability and high strength and a method of manufacturing the same.

BACKGROUND ART

Recently, the automobile industry has paid attention to a method, capable of achieving lightweightness of materials to protect the global environment and securing safety of passengers. To satisfy such a requirement for safety and lightweightness, application of high-strength steel sheets has rapidly been increased. In general, the higher strength of a steel sheet, the lower ductility and workability of the steel sheet. Therefore, in a steel sheet for automobile members, a steel sheet having excellent strength, ductility, and workability is required.

As technologies to improve ductility of a steel sheet, a method of utilizing tempered martensite is disclosed in Korean Patent Publication No. 10-2006-0118602 and Japanese Laid-Open Patent Publication No. 2009-019258. Tempered martensite, formed by tempering hard martensite, is a softened martensite and exhibits strength different from strength of existing untempered martensite (fresh martensite). When fresh martensite is inhibited and tempered martensite is formed, ductility and workability may be increased.

Unfortunately, in the technologies disclosed in Korean Patent Publication No. 10-2006-0118602 and Japanese Laid-Open Patent Publication No. 2009-019258, a product of tensile strength and elongation (TS×El) fails to satisfy 22,000 MPa % or more, which means that it may be difficult to secure a steel sheet having excellent strength and ductility.

Transformation-induced plasticity (TRIP) steel has been developed such that a steel sheet for automobile members has excellent ductility and workability while having high strength. TRIP steels having excellent ductility and workability are disclosed in Patent Documents 3 and 4.

Korean Patent Publication No. 10-2014-0012167 attempts to improve ductility and workability including polygonal ferrite, retained austenite, and martensite, but high strength is not secured because bainite is a main phase. In addition, Ts×El dose not satisfy 22,000 MPa %.

According to Korean Patent Publication No. 10-2010-0092503, ductility and workability are improved by forming ferrite, refining retained austenite, and forming a composite structure including tempered martensite, but it may be difficult to secure high strength because a large amount of soft ferrite is contained.

It is a situation that has not yet met the demand for a steel sheet having high strength and excellent ductility and workability at the same time.

DISCLOSURE

Technical Problem

An aspect of the present disclosure is to provide a high-strength steel sheet having excellent ductility and workability by optimizing a composition and a microstructure of the steel sheet, and a method of manufacturing the same.

On the other hand, the feature of the present disclosure is not limited to the above description. It will be understood by those skilled in the art that there would be no difficulty in understanding additional features of the present disclosure.

Technical Solution

According to an aspect of the present disclosure, a high-strength steel sheet includes, by weight %, carbon (C): more than 0.25% to 0.75%, silicon (Si): 4.0% or less, manganese (Mn): 0.9 to 5.0%, aluminum (Al): 5.0% or less, phosphorus (P): 0.15% or less, sulfur (S): 0.03% or less, nitrogen (N): 0.03% or less, and a balance of iron (Fe) and inevitable impurities. A microstructure includes tempered martensite, bainite, and retained austenite. The high-strength steel sheet satisfies the following Relational Expression 1, $$0.55 \leq [Si+Al]\gamma/[Si+Al]av \leq 0.85, \quad \text{[Relational Expression 1]}$$

where [Si+Al]γ is a content (weight %) of Si and Al contained in the retained austenite, and [Si+Al]av is a content (weight %) of Si and Al contained in the high-strength steel sheet.

According to another aspect of the present disclosure, a method of manufacturing a high-strength steel sheet having excellent ductility and workability includes: heating a steel slab and hot rolling the heated steel slab to obtain a hot-rolled steel sheet, the steel slab comprising, by weight %, carbon (C): more than 0.25% to 0.75%, silicon (Si): 4.0% or less, manganese (Mn): 0.9 to 5.0%, aluminum (Al): 5.0% or less, phosphorus (P): 0.15% or less, sulfur (S): 0.03% or less, nitrogen (N): 0.03% or less, and a balance of iron (Fe) and inevitable impurities; coiling the hot-rolled steel sheet; performing a hot-rolling annealing heat treatment on the coiled steel sheet in a temperature range of 650 to 850° C. for 600 to 1700 seconds; cold rolling the coiled steel sheet subjected to the hot-rolling annealing heat treatment; heating the cold-rolled steel sheet to Ar3 or higher (first heating) and holding the first-heated steel sheet for 50 seconds or more (first holding); cooling the first-heated steel sheet to a temperature range of 100 to 300° C. at an average cooling rate of 1° C./sec (first cooling); heating the first-cooled steel sheet to a temperature range of 300 to 500° C. (second heating) and holding the second-heated steel sheet in the temperature range of 300 to 500° C. for 50 seconds or more (second holding); and cooling the second-heated steel sheet to room temperature.

Advantageous Effects

As set forth above, excellent ductility and working characteristics of high-strength steel may be secured to provide a steel sheet used for an automobile structure required to have both lightweight and safety.

BEST MODE FOR INVENTION

The inventors of the present invention have recognized that strength, ductility, and workability of transformation-inducted plasticity (TRIP) steel including bainite and tempered martensite and including the retained austenite, were affected by the stabilization of retained austenite and a size and a shape of the retained austenite. By identifying this, a method of improving ductility and workability of high-strength steel was devised, leading to completion of the present disclosure.

Hereinafter, the present disclosure will be described in detail. First, an alloy composition of a steel sheet according to the present disclosure will be described in detail.

The steel sheet according to the present disclosure may include, by weight % (hereinafter, %), carbon (C): more than 0.25% to 0.75%, silicon (Si): 4.0% or less, manganese (Mn): 0.9 to 5.0%, aluminum (Al): 5.0% or less, phosphorus (P): 0.15% or less, sulfur (S): 0.03% or less, nitrogen (N): 0.03% or less, and a balance of iron (Fe) and inevitable impurities. The steel sheet may further include titanium (Ti): 0 to 0.5%, niobium (Nb): 0 to 0.5%, vanadium (V): 0 to 0.5%, chromium (Cr): 0 to 3.0%, molybdenum (Mo): 0 to 3.0%, copper (Cu): 0 to 4.5%, nickel (Ni): 0 to 4.5%, boron (B): 0 to 0.005%, calcium (Ca): 0 to 0.05%, a rare earth element (REM) except yttrium (Y): 0 to 0.05%, magnesium (Mg): 0 to 0.05%, tungsten (W): 0 to 0.5%, zirconium (Zr): 0 to 0.5%, antimony (Sb): 0 to 0.5%, tin (Sn): 0 to 0.5%, yttrium (Y): 0 to 0.2%, hafnium (Hf): 0 to 0.2%, and cobalt (Co): 0 to 1.5%. Hereinafter, each alloy component will be described in detail.

Carbon (C): More than 0.25% to 0.75%

Carbon is an element essential for providing strength of a steel sheet, and is an element for stabilizing retained austenite increasing ductility of the steel sheet. When the content of carbon is 0.25% or less, it may be difficult to secure required tensile strength. When the content of carbon is greater than 0.75%, it may be difficult to perform cold rolling, and thus, a steel sheet may not be manufactured. Therefore, the content of carbon may be, in detail, more than 0.25% to 0.75% or less. The content of carbon may be, in further detail, 0.31 to 0.75%.

Silicon (Si): 4.0% or Less (Excluding 0)

Silicon is an element effective in improving strength by solid solution strengthening, and is an element strengthening ferrite, uniformizing a structure, and improving workability. In addition, silicon is an element contributing to formation of retained austenite by suppressing precipitation of cementite. When the content of Si is greater than 4.0%, plating defects such as an unplated spot may occur in a plating process and weldability of the steel sheet may be deteriorated. Therefore, the content of silicon may be, in detail, 4.0% or less.

Aluminum (Al): 5.0% or Less (Excluding 0)

Aluminum is an element combining with oxygen, contained in steel, to deoxidize the steel. Similarly to silicon, aluminum is also an element suppressing the predication of cementite to stabilize retained austenite. When the content of aluminum is greater than 5.0%, workability of the steel sheet may be deteriorated and an inclusion may be increased. Therefore, the content of aluminum may be, in detail, 5.0% or less.

The sum of silicon and aluminum (Si+Al) may be, in detail, 1.0 to 6.0%. In the present disclosure, silicon and aluminum are components affecting formation of a microstructure to affect ductility and bending workability. Therefore, to have excellent ductility and bending workability, the sum of silicon and aluminum may be, in detail, 1.0 to 6.0% and, in further detail, 1.5 to 4.0%.

Manganese (Mn): 0.9 to 5.0%

Manganese is an element effective in improving strength and ductility. Such an effect may be obtained when the content of manganese is 0.9% or more, but weldability and impact toughness of the steel sheet may be deteriorated when the content of manganese is greater than 5.0%. In addition, when manganese is included in an amount greater than 5.0%, a bainite transformation time may be increased to cause insufficient enrichment of carbon contained in austenite, and thus, a fraction of retained austenite may not be secured. Therefore, the content of manganese may be, in detail, 0.9 to 5.0%.

Phosphorus (P): 0.15% or Less

Phosphorus is an element contained as an impurity to deteriorate impact toughness. Therefore, the content of phosphorus may be managed to be, in detail, 0.15% or less.

Sulfur (S): 0.03% or Less

Sulfur is an element contained as an impurity to form MnS in the steel sheet and to deteriorate ductility. Therefore, the content of sulfur may be, in detail, 0.03% or less.

Nitrogen (N): 0.03% or Less

Nitrogen is an element contained as an impurity to form a nitride during continuous casting, causing cracking of a slab. Therefore, the content of nitrogen may be, in detail, 0.03% or less.

The balance includes iron (Fe) and inevitable impurities. The steel sheet according to the present disclosure may further have an ally composition, other than the above-described alloy composition, which will be described below in detail.

At Least One of Titanium (Ti): 0 to 0.5%, Niobium (Nb): 0 to 0.5%, and Vanadium (V): 0 to 0.5%

Titanium, niobium, and vanadium are elements forming precipitates to refine crystal grains, and may be contained to improve strength and impact toughness of the steel sheet. When the content of each of titanium, niobium, and vanadium is greater than 0.5%, precipitates may be excessively formed to reduce impact toughness and to cause an increase in manufacturing costs. Therefore, the content of each of titanium, niobium, and vanadium may be, in detail, 0.5% or less.

At Least One of Chromium (Cr): 0 to 3.0% and Molybdenum (Mo): 0 to 3.0%

Chromium and molybdenum are elements suppressing decomposition of austenite during an alloying treatment. Similarly to manganese, chromium and molybdenum are elements stabilizing austenite. When the content of each of chromium and molybdenum is greater than 3.0%, a bainite transformation time may be increased to cause insufficient enrichment of carbon contained in austenite, and thus, a required fraction of retained austenite may not be obtained. Therefore, the content of each of chromium and molybdenum may be, in detail, 3.0% or less.

At Least One of Copper (Cu): 0 to 4.5% and Nickel (Ni): 0 to 4.5%

Copper and nickel are elements stabilizing austenite and inhibiting corrosion. In addition, copper and nickel are enriched in a surface of the steel sheet such that permeation of hydrogen, migration into the steel sheet, is prevented to inhibit hydrogen-delayed fracture. When the content of each of copper and nickel is greater than 4.5%, not only an excessive characteristic effect but also an increase in manufacturing costs may occur. Therefore, the content of each of copper and nickel may be, in detail, 4.5% or less.

Boron (B): 0 to 0.005%

Boron is an element improving hardenability, increasing strength, and suppressing nucleation of grain boundaries. When the content of boron is greater than 0.005%, not only an excessive characteristic effect but also an increase in manufacturing costs may occur. Therefore, the content of boron may be, in detail, 0.005% or less.

At Least One of Calcium (Ca): 0 to 0.05%, Magnesium (Mg): 0 to 0.05% and a Rare Earth Element (REM) Except Yttrium (Y): 0 to 0.05%

The REM refers to a total of 17 elements of scandium (Sc), yttrium (Y), and lanthanide. Calcium, magnesium, and REM except yttrium may spheroidize sulfide to improve ductility of the steel sheet. When the content of the calcium, magnesium, and REM except yttrium is greater than 0.05%, not only an excessive characteristic effect but also an increase in manufacturing costs may occur. Therefore, the content of the calcium, magnesium, and REM except yttrium may be, in detail, 0.05% or less.

At Least One of Tungsten (W): 0 to 0.5% and Zirconium (Zr): 0 to 0.5%

Tungsten and zirconium are elements improving quenchability to increase the strength of the steel sheet. When the content of each of tungsten and zirconium is greater than 0.5%, not only an excessive characteristic effect but also an increase in manufacturing costs may occur. Therefore, the content of each of tungsten and zirconium may be, in detail, 0.5% or less.

At Least One of Antimony (Sb): 0 to 0.5% and Tin (Sn): 0 to 0.5%

Antimony and tin are elements improving plating wettability and plating adhesion of the steel sheet. When the content of each of antimony and tin is greater than 0.5%, embrittlement of the steel sheet may be increased to cause cracking during hot working or cold working. Therefore, the content of each of antimony and tin may be 0.5% or less.

At Least One of Yttrium (Y): 0 to 0.2% and Hafnium (Hf): 0 to 0.2%

Yttrium and hafnium are elements improving corrosion resistance of the steel sheet. When the content of each of yttrium and hafnium is greater than 0.2%, ductility of the steel sheet may be deteriorated. Therefore, the content of each of yttrium and hafnium may be, in detail, 0.2% or less.

Cobalt (Co): 0 to 1.5%

Cobalt is an element promoting bainite transformation to increase a TRIP effect. When the content of cobalt is greater than 1.5%, weldability and ductility of the steel sheet may be deteriorated. Therefore, the content of cobalt may be, in detail, 1.5% or less.

A microstructure of the steel sheet according to the present disclosure may include tempered martensite, bainite, and retained austenite. As an example, the microstructure may include, by volume fraction, 30 to 75% of tempered martensite, 10 to 50% of bainite, 10 to 40% of retained austenite, and may include 5% or less of ferrite and other inevitable structures. The inevitable structures may include fresh martensite, pearlite, martensite-austenite constituent (M-A), and the like. When the fresh martensite or the pearlite is excessively formed, the ductility and the workability of the steel sheet may be deteriorated or a fraction of retained austenite may be reduced.

As can be seen from Relational Expression 1, a value obtained by dividing the content of silicon and aluminum contained in the retained austenite ([Si+Al]γ, weight %) by the content of silicon and aluminum contained in the steel sheet ([Si+Al]av, weight %) may be within the range of, in detail, 0.55 to 0.85.

$$0.55 \leq [Si+Al]\gamma/[Si+Al]av \leq 0.85 \quad \text{[Relational Expression 1]}$$

In the steel sheet according to the present disclosure, a product of tensile strength and elongation (Ts×El) is 22,000 MPa % or more and R/t is 0.5 to 3.0 (R is a minimum bending radius (mm) at which cracking does not occur and t is a thickness (mm) of the steel sheet, after a 90° bending test). In this regard, the steel sheet has an excellent balance of strength and ductility and excellent workability.

In the present disclosure, in order to secure excellent ductility and workability, it is important to stabilize retained austenite of the steel sheet. In order to stabilize the retained austenite, it is necessary to enrich carbon and manganese, contained in ferrite, bainite, and tempered martensite of the steel sheet, into austenite. However, when carbon is enriched into the austenite using ferrite, strength of the steel sheet may be insufficient due to low strength characteristics of the ferrite. Accordingly, carbon and manganese may be enriched into the austenite using, in detail, the bainite and the tempered martensite. In addition, when the content of silicon and aluminum in the retained austenite ([Si+Al]γ) is controlled, a large amount of carbon and manganese may be enriched into the retained austenite from the bainite and the tempered martensite. Accordingly, silicon and aluminum in the retained austenite may be controlled to stabilize the retained austenite. Therefore, in the present disclosure, the retained austenite may be stabilized by setting [Si+Al]γ/[Si+Al]av to 0.55 or more. However, in the case in which [Si+Al]γ/[Si+Al]av is greater than 0.85, enrichment of carbon and manganese in the retained austenite may be insufficient, so that the retained austenite may be destabilized by tensile strain to reduce ductility and workability. Thus, Ts×El may be less than 22,000 MPa % or R/t may be greater than 3.0. As a result, the above case is not preferable.

A steel sheet, containing retained austenite, has excellent ductility and workability due to the transformation-induced plasticity occurring at the time of transformation from austenite to martensite during working. When the retained austenite of the steel sheet is less than 10%, TS×El may be less than 22,000 MPa % or R/t may be greater than 3.0. On the other hand, when a retained austenite fraction is greater than 40%, local elongation may be decreased. Therefore, to obtain a steel sheet having both excellent balance of strength and ductility and excellent workability, a fraction of the retained austenite may be, in detail, 10 to 40%.

Both untempered martensite (fresh martensite) and tempered martensite are microstructures improving strength of a steel sheet. However, as compared with the tempered martensite, the fresh martensite may have characteristics to significantly reduce ductility of the steel sheet. This is because a microstructure of the tempered martensite is softened by a tempering heat treatment. Therefore, the tempered martensite may be utilized to provide the steel sheet having an excellent balance of strength and ductility and excellent workability. In the case in which a fraction (volume fraction) of the tempered martensite is less than 30%, it may be difficult to secure more than 22,000 MPa % of TS×El. In the case in which the fraction of the tempered martensite is greater than 75%, ductility and workability may be reduced, so that Ts×El may be less than 22,000 MPa % or R/t may be greater than 3.0. As a result, both of the two cases are not preferable.

Bainite may be appropriately contained to improve balance of strength and ductility and workability. In the case in which the fraction (volume fraction) of the bainite is 10% or more, Ts×El may be implemented to be 22,000 MPa % or more and R/t may be implemented to be within the range of 0.5 to 3.0. However, in the case of more than 50% of bainite, the fraction of the tempered martensite may be relatively reduced, so that Ts×El may be less than 22,000 MPa %. As a result, the latter case is not preferable.

Hereinafter, an example of a method of manufacturing a steel sheet according to the present disclosure will be described in detail. The method according to the present disclosure may start with an operation of preparing a steel ingot or a steel slab having the above-described alloy composition. The steel ingot or the steel slab is heated to be hot-rolled, and then annealed, coiled, pickled, and cold-rolled to prepare a cold-rolled steel sheet.

As an example, the steel ingot or the steel slab may be heated to a temperature of 1000 to 1350° C., and may be finish hot-rolled at a temperature of 800 to 1000° C. When the heating temperature is less than 1000° C., there is a probability that the steel ingot or the steel slab is hot-rolled in a range of the finish hot rolling temperature or less. In addition, when the heating temperature is greater than 1350° C., the steel ingot or the steel sheet may reach a melting point of the steel to melt. On the other hand, when the finish hot rolling temperature is less than 800° C., a heavy burden may be placed on the rolling mill due to high strength of the steel. In addition, when the finish hot rolling temperature is greater than 1000° C., crystal grains of the steel sheet may be coarsened after the hot rolling, and thus, physical properties of the high-strength steel sheet may be deteriorated. To refine the crystal grains of the hot-rolled steel sheet, the hot-rolled sheet may be cooled at a cooling rate of 10° C./sec or higher after the finishing hot rolling, and then may be coiled at a temperature of 300 to 600° C. When the coiling temperature is less than 300° C., the coiling may not be easily performed. When the coiling temperature is greater than 600° C., a scale formed on a surface of the hot-rolled steel sheet may reach the inside of the steel sheet to have difficulty in performing pickling.

A hot-rolling annealing heat treatment may be performed to facilitate pickling and cold rolling after the coiling. The hot-rolling annealing heat treatment may be performed within a temperature range of 650 to 850° C. for 600 to 1700 seconds. When the hot-rolling annealing heat treatment temperature is less than 650° C. or the hot-rolling annealing heat treatment is performed for less than 600 seconds, strength of the hot-rolled annealing heat-treated steel sheet may be high, so that the cold rolling may not be easily performed. On the other hand, when the hot-rolling annealing heat treatment temperature is greater than 850° C. or the hot-rolling annealing heat treatment is performed for more than 1700 seconds, pickling may not be easily performed due to a scale formed to reach a deep inside of the steel sheet.

After the coiling, the steel sheet may be pickled and cold-rolled to remove the scale formed on the surface of the steel sheet. Conditions for the pickling and cold rolling are not limited, and the cold rolling may be performed at a cumulative reduction ratio of 30 to 90%. When the cold rolling cumulative reduction ratio is greater than 90%, it may be difficult to perform cold rolling for a short time due to the high strength of the steel sheet.

The cold-rolled steel sheet may be manufactured as an unplated cold-rolled steel sheet through an annealing heat treatment process, or may be manufactured as a plated steel sheet through a plating process to provide corrosion resistance. The plating may employ a plating method such as hot-dip galvanizing, electro-galvanizing, or hot-dip aluminum plating, and the method and type thereof are not limited.

An annealing heat treatment process may be performed to secure high strength and excellent ductility and workability according to the present invention. Hereinafter, an example thereof will be described in detail.

The cold-rolled steel sheet is heated to Ac3 or more (first heating), and is held for 50 seconds or more (first holding).

When a temperature of the first heating or the first holding is less than Ac3, ferrite may be formed, and bainite, retained austenite, and tempered martensite may be insufficiently formed to reduce [Si+Al]γ/[Si+Al]av and TS×El of the steel sheet. In addition, when a time of the first holding is less than 50 seconds, a structure may be insufficiently homogenized to deteriorate physical properties of the steel sheet. An upper limit of the first heating temperature and an upper limit of the first holding time are not limited, but to suppress a decrease in toughness caused by grain coarsening, the first heating temperature may be, in detail, 950° C. or less, and the first holding time may be, in detail, 1200 seconds or less.

After the first holding, the steel sheet may be cooled, in detail, at an average cooling rate of 1° C./sec or more to a first cooling stop temperature range of 100 to 300° C. (first cooling). An upper limit of the first cooling rate does not need to be defined, and may be set to be, in detail, 100° C./sec or less. When the first cooling stop temperature is less than 100° C., tempered martensite may be excessively formed and retained austenite may be insufficient, so that [Si+Al]γ/[Si+Al]av, TS×El, and bending workability of the steel sheet may be reduced. On the other hand, when the first cooling stop temperature is greater than 300° C., bainite becomes excessive and tempered martensite may be insufficient, so that TS×El of the steel sheet may be reduced.

After the first cooling, the steel sheet may be heated, in detail, to a temperature range of 300 to 500° C. at a temperature increase rate of 5° C./sec or more (second heating), and then held for 50 seconds or more within the temperature range (second holding). An upper limit of the heating rate does not need to be defined and may be, in detail, 100° C./s or less. When a temperature of the second heating or the second holding is less than 300° C. or a time of the second holding is less than 50 seconds, tempered martensite may become excessive and contents of silicon and aluminum contained in retained austenite may be insufficiently controlled, so that it may be difficult to secure a fraction of the retained austenite. As a result, [Si+Al]γ/[Si+Al]av, TS×El, and bending workability of the steel sheet may be reduced. On the other hand, when the temperature of the secondary heating or second holding is greater than 500° C. or the time of second holding is greater than 172,000 seconds, the contents of silicon and aluminum contained in the retained austenite may be insufficient controlled, so that it may be difficult to secure the fraction of the retained austenite. As a result, [Si+Al]γ/[Si+Al]av and TS×El of the steel sheet may be reduced.

After the second holding, the steel sheet may be cooled, in detail, to room temperature at an average cooling rate of 1° C./sec or more (second cooling).

MODE FOR INVENTION

Hereinafter, embodiments of the present disclosure will be described more specifically through examples. However, the examples are for clearly explaining the embodiments of the present disclosure and are not intended to limit the scope of the present disclosure.

Example

A steel slab having a thickness of 100 mm, having an alloy composition listed in Table 1 (a balance is iron (Fe) and inevitable impurities), was prepared. The steel slab was heated at a temperature of 1200° C., and then finish hot-rolled at a temperature of 900° C. The hot-rolled steel slab was cooled at an average cooling rate of 30° C./sec and then coiled in a temperature range of 450 to 550° C. to prepare a hot-rolled steel sheet having a thickness of 3 mm. The hot-rolled steel sheet was subjected to a hot-rolling annealing heat treatment under the conditions listed in Tables 2 and 3. The annealed hot-rolled steel sheet was pickled to remove surface scale, and then cold rolling was performed to a thickness of 1.5 mm.

Then, a heat treatment was performed under the annealing heat treatment conditions listed in Tables 2 to 5 to manufacture a steel sheet.

A microstructure of the manufactured steel sheet was observed, and results thereof are listed in Tables 6 and 7. In the microstructure, ferrite F, bainite B, tempered martensite TM, and pearlite P were observed through a scanning electron microscope (SEM) after performing Nital etching on a cross-section of a polished specimen. Fractions of the bainite and the tempered martensite, which are difficult to be distinguished from each other, were calculated using an expansion curve after a dilation evaluation. Since it is also difficult to distinguish fresh martensite FM and retained austenite (retained γ) from each other, a value obtained by subtracting a fraction of the retained austenite, calculated using an X-ray diffraction method, from the fractions of the martensite and the retained austenite, observed with the SEM, was determined as a fraction of the fresh martensite.

On the other hand, [Si+Al]γ/[Si+Al]av, TS×El, and R/t of the manufactured steel sheet were observed, and results thereof are listed in Tables 8 and 9.

The content of silicon and aluminum ([Si+Al]γ), contained in the retained austenite, was determined as a Si+Al content measured in a retained austenite phase using an electron probe microanalyzer (EPMA). The [Si+Al]av refers to an average Si+Al content of the entire steel sheet.

The TS×El and R/t were evaluated by a tensile test and a V-bending test. In the tensile test, a taken test specimen was evaluated according to JIS No. 5 standard, based on a 90° direction with respect to a rolling direction of a rolling sheet, to determine TS×El. In addition, R/t was determined as a value obtained by dividing a minimum bending radius R, at which cracking did not occur after a 90° bending test by taking a test specimen based on the 90° direction with respect to the rolling direction of the rolling sheet, by a thickness t of the rolling sheet.

In Tables 2 to 9, "IE" will represent "Inventive Example," and "CE" will represent "Comparative Example."

TABLE 1

| Type of | Chemical Composition (wt %) | | | | | | | | | |
|---|---|---|---|---|---|---|---|---|---|---|
| Steel | C | Si | Mn | P | S | Al | N | Cr | Mo | Others |
| A | 0.39 | 1.98 | 2.13 | 0.011 | 0.0008 | 0.02 | 0.0032 | 0.51 | | |
| B | 0.38 | 2.03 | 2.21 | 0.010 | 0.0013 | 0.02 | 0.0028 | 0.23 | 0.18 | |
| C | 0.37 | 1.95 | 1.88 | 0.010 | 0.0010 | 0.02 | 0.0029 | | 0.47 | |
| D | 0.33 | 2.31 | 3.95 | 0.009 | 0.0012 | 0.03 | 0.0030 | | 0.49 | |
| E | 0.41 | 1.85 | 2.06 | 0.008 | 0.0009 | 0.03 | 0.0031 | | | |
| F | 0.52 | 1.68 | 2.33 | 0.009 | 0.0008 | 0.02 | 0.0027 | | | |
| G | 0.72 | 1.64 | 2.41 | 0.012 | 0.0011 | 0.02 | 0.0034 | | | |
| H | 0.38 | 0.87 | 2.11 | 0.011 | 0.0010 | 1.93 | 0.0033 | | | |
| I | 0.36 | 1.08 | 2.07 | 0.011 | 0.0013 | 2.35 | 0.0031 | | | |
| J | 0.35 | 0.02 | 1.95 | 0.010 | 0.0010 | 4.67 | 0.0030 | | | Ti: 0.05 |
| K | 0.43 | 1.74 | 1.93 | 0.008 | 0.0011 | 0.02 | 0.0035 | | | Nb: 0.05 |
| L | 0.41 | 1.89 | 1.88 | 0.009 | 0.0011 | 0.02 | 0.0028 | | | V: 0.05 |
| M | 0.39 | 1.75 | 1.92 | 0.011 | 0.0012 | 0.02 | 0.0027 | | | Ni: 0.36 |
| N | 0.38 | 1.89 | 2.18 | 0.012 | 0.0013 | 0.03 | 0.0024 | | | Cu: 0.35 |
| O | 0.38 | 1.68 | 2.22 | 0.013 | 0.0007 | 0.03 | 0.0028 | | | B: 0.003 |
| P | 0.36 | 1.88 | 2.26 | 0.012 | 0.0008 | 0.02 | 0.0026 | | | Ca: 0.002 |
| Q | 0.37 | 1.84 | 2.37 | 0.008 | 0.0009 | 0.02 | 0.0031 | | | REM: 0.001 |
| R | 0.44 | 1.73 | 2.45 | 0.009 | 0.0009 | 0.02 | 0.0031 | | | Mg: 0.001 |
| S | 0.42 | 1.77 | 2.38 | 0.010 | 0.0010 | 0.02 | 0.0034 | | | W: 0.11 |
| T | 0.31 | 1.95 | 2.19 | 0.010 | 0.0011 | 0.02 | 0.0033 | | | Zr: 0.10 |
| U | 0.32 | 1.98 | 2.03 | 0.009 | 0.0013 | 0.03 | 0.0032 | | | Sb: 0.02 |
| V | 0.39 | 1.82 | 2.41 | 0.008 | 0.0012 | 0.02 | 0.0030 | | | Sn: 0.02 |
| W | 0.36 | 1.78 | 2.26 | 0.009 | 0.0012 | 0.02 | 0.0027 | | | Y: 0.01 |
| X | 0.37 | 3.64 | 2.14 | 0.009 | 0.0007 | 0.03 | 0.0029 | | | Hf: 0.01 |
| Y | 0.37 | 2.27 | 2.18 | 0.011 | 0.0007 | 0.03 | 0.0028 | | | Co: 0.35 |
| XA | 0.21 | 1.92 | 2.05 | 0.011 | 0.0008 | 0.03 | 0.0024 | | | |
| XB | 0.78 | 1.94 | 2.11 | 0.008 | 0.0011 | 0.02 | 0.0031 | | | |
| XC | 0.39 | 0.02 | 2.16 | 0.012 | 0.0012 | 0.03 | 0.0027 | | | |
| XD | 0.38 | 4.26 | 2.07 | 0.012 | 0.0009 | 0.02 | 0.0032 | | | |
| XE | 0.40 | 0.03 | 2.31 | 0.008 | 0.0010 | 5.31 | 0.0026 | | | |
| XF | 0.41 | 1.84 | 0.75 | 0.009 | 0.0010 | 0.02 | 0.0033 | | | |
| XG | 0.38 | 1.88 | 5.64 | 0.011 | 0.0012 | 0.02 | 0.0031 | | | |
| XH | 0.38 | 1.96 | 2.20 | 0.010 | 0.0011 | 0.02 | 0.0030 | 3.38 | | |
| XI | 0.36 | 1.89 | 2.08 | 0.009 | 0.0010 | 0.02 | 0.0027 | | 3.41 | |

TABLE 2

| | No. | Type of Steel | CT of HRSS (° C.) | AT of HRSS (° C.) | A-Time of HRSS (s) | 1st AHR (° C./s) | 1st HT (° C.) | 1st H-Time (s) |
|---|---|---|---|---|---|---|---|---|
| IE | 1 | A | 500 | 750 | 1200 | 10 | 880 | 120 |
| CE | 2 | A | 500 | 900 | 1000 | Poor Pickling | | |
| CE | 3 | A | 500 | 600 | 1300 | Fracture occurred during cold rolling | | |
| CE | 4 | A | 450 | 750 | 1800 | Poor Pickling | | |
| CE | 5 | A | 500 | 750 | 500 | Fracture occurred during cold rolling | | |
| CE | 6 | A | 500 | 750 | 1500 | 10 | 730 | 120 |
| CE | 7 | A | 550 | 750 | 1200 | 10 | 880 | 1 |
| CE | 8 | A | 500 | 750 | 1200 | 10 | 880 | 120 |
| IE | 9 | B | 500 | 700 | 1300 | 10 | 880 | 120 |
| IE | 10 | B | 500 | 750 | 1000 | 10 | 880 | 120 |
| IE | 11 | B | 550 | 750 | 800 | 10 | 880 | 120 |
| IE | 12 | C | 500 | 800 | 1000 | 10 | 880 | 120 |
| CE | 13 | C | 500 | 750 | 1200 | 10 | 880 | 120 |
| CE | 14 | C | 450 | 750 | 1100 | 10 | 880 | 120 |

TABLE 2-continued

| | No. | Type of Steel | CT of HRSS (° C.) | AT of HRSS (° C.) | A-Time of HRSS (s) | 1st AHR (° C./s) | 1st HT (° C.) | 1st H-Time (s) |
|---|---|---|---|---|---|---|---|---|
| CE | 15 | C | 500 | 700 | 1100 | 10 | 880 | 120 |
| CE | 16 | C | 550 | 750 | 1000 | 10 | 880 | 120 |
| CE | 17 | C | 500 | 800 | 1300 | 10 | 880 | 120 |
| CE | 18 | C | 500 | 750 | 1500 | 10 | 880 | 120 |
| IE | 19 | D | 500 | 750 | 1600 | 10 | 880 | 120 |
| IE | 20 | E | 500 | 650 | 900 | 10 | 880 | 120 |
| IE | 21 | F | 550 | 850 | 1000 | 10 | 880 | 120 |
| IE | 22 | G | 450 | 750 | 1700 | 10 | 880 | 120 |
| IE | 23 | H | 500 | 800 | 1200 | 10 | 880 | 120 |
| IE | 24 | I | 450 | 750 | 600 | 10 | 880 | 120 |
| IE | 25 | J | 500 | 750 | 1400 | 10 | 880 | 120 |

CT of HRSS: coiling temperature of hot-rolled steel sheet
AT of HRSS: annealing temperature of hot-rolled steel sheet
A-Time of HRSS: annealing time of hot-rolled steel sheet
1st AHR: first average heating rate
1st HT: first holding temperature
1st H-Time: first holding time

TABLE 3

| | No. | Type of Steel | CT of HRSS (° C.) | AT of HRSS (° C.) | A-Time of HRSS (s) | 1st AHR (° C./s) | 1st HT (° C.) | 1st H-Time (s) |
|---|---|---|---|---|---|---|---|---|
| IE | 26 | K | 500 | 750 | 1000 | 10 | 880 | 120 |
| IE | 27 | L | 500 | 750 | 1200 | 10 | 880 | 120 |
| IE | 28 | M | 550 | 700 | 1500 | 10 | 880 | 120 |
| IE | 29 | N | 500 | 700 | 1100 | 10 | 880 | 120 |
| IE | 30 | O | 500 | 700 | 1500 | 10 | 880 | 120 |
| IE | 31 | P | 450 | 750 | 1300 | 10 | 880 | 120 |
| IE | 32 | Q | 450 | 750 | 1200 | 10 | 880 | 120 |
| IE | 33 | R | 500 | 750 | 1200 | 10 | 880 | 120 |
| IE | 34 | S | 500 | 750 | 1400 | 10 | 880 | 120 |
| IE | 35 | T | 500 | 800 | 1200 | 10 | 880 | 120 |
| IE | 36 | U | 550 | 800 | 1600 | 10 | 880 | 120 |
| IE | 37 | V | 500 | 750 | 1100 | 10 | 880 | 120 |
| IE | 38 | W | 450 | 750 | 1200 | 10 | 880 | 120 |
| IE | 39 | X | 500 | 750 | 1200 | 10 | 880 | 120 |
| IE | 40 | Y | 450 | 750 | 900 | 10 | 880 | 120 |
| CE | 41 | XA | 500 | 800 | 1500 | 10 | 880 | 120 |
| CE | 42 | XB | 500 | 750 | 1300 | 10 | 880 | 120 |
| CE | 43 | XC | 500 | 700 | 1100 | 10 | 880 | 120 |
| CE | 44 | XD | 550 | 750 | 1400 | 10 | 880 | 120 |
| CE | 45 | XE | 500 | 750 | 1200 | 10 | 880 | 120 |
| CE | 46 | XF | 500 | 700 | 1600 | 10 | 880 | 120 |
| CE | 47 | XG | 450 | 750 | 1700 | 10 | 880 | 120 |
| CE | 48 | XH | 500 | 750 | 1400 | 10 | 880 | 120 |
| CE | 49 | XI | 500 | 750 | 1200 | 10 | 880 | 120 |

CT of HRSS: coiling temperature of hot-rolled steel sheet
AT of HRSS: annealing temperature of hot-rolled steel sheet
A-Time of HRSS: annealing time of hot-rolled steel sheet
1st AHR: first average heating rate
1st HT: first holding temperature
1st H-Time: first holding time

TABLE 4

| | No. | Type of Steel | 1st ACR (° C./s) | 1st CST (° C.) | 2nd AHR (° C./s) | 2nd HT (° C.) | 2nd H-Time (s) | 2nd ACR (° C./s) |
|---|---|---|---|---|---|---|---|---|
| IE | 1 | A | 20 | 180 | 15 | 400 | 300 | 10 |
| CE | 2 | A | Poor Picking | | | | | |
| CE | 3 | A | Fracture occurred during cold rolling | | | | | |
| CE | 4 | A | Poor Pickling | | | | | |
| CE | 5 | A | Fracture occurred during cold rolling | | | | | |
| CE | 6 | A | 20 | 220 | 15 | 400 | 300 | 10 |
| CE | 7 | A | 20 | 200 | 15 | 400 | 300 | 10 |
| CE | 8 | A | 0.5 | 200 | 15 | 400 | 300 | 10 |
| IE | 9 | B | 20 | 250 | 15 | 400 | 300 | 10 |
| IE | 10 | B | 20 | 130 | 15 | 350 | 600 | 10 |

TABLE 4-continued

| | No. | Type of Steel | 1st ACR (° C./s) | 1st CST (° C.) | 2nd AHR (° C./s) | 2nd HT (° C.) | 2nd H-Time (s) | 2nd ACR (° C./s) |
|---|---|---|---|---|---|---|---|---|
| IE | 11 | B | 20 | 270 | 15 | 450 | 300 | 10 |
| IE | 12 | C | 20 | 220 | 15 | 400 | 300 | 10 |
| CE | 13 | C | 20 | 70 | 15 | 400 | 300 | 10 |
| CE | 14 | C | 20 | 330 | 15 | 400 | 300 | 10 |
| CE | 15 | C | 20 | 210 | 15 | 270 | 300 | 10 |
| CE | 16 | C | 20 | 210 | 15 | 530 | 300 | 10 |
| CE | 17 | C | 20 | 180 | 15 | 400 | 40 | 10 |
| CE | 18 | C | 20 | 180 | 15 | 400 | 172,800 | 10 |
| IE | 19 | D | 20 | 180 | 15 | 400 | 300 | 10 |
| IE | 20 | E | 20 | 180 | 15 | 400 | 300 | 10 |
| IE | 21 | F | 20 | 200 | 15 | 400 | 300 | 10 |
| IE | 22 | G | 20 | 200 | 15 | 350 | 300 | 10 |
| IE | 23 | H | 20 | 200 | 15 | 400 | 600 | 10 |
| IE | 24 | I | 20 | 200 | 15 | 400 | 300 | 10 |
| IE | 25 | J | 20 | 220 | 15 | 400 | 300 | 10 |

1st ACR: first average cooling rate
1st CST: first cooling stop temperature
2nd AHR: second average heating rate
2nd HT: second holding temperature
2nd H-Time: second holding time
2nd ACR: second average cooling rate

TABLE 5

| | No. | Type of Steel | 1st ACR (° C./s) | 1st CST (° C.) | 2nd AHR (° C./s) | 2nd HT (° C.) | 2nd H-Time (s) | 2nd ACR (° C./s) |
|---|---|---|---|---|---|---|---|---|
| IE | 26 | K | 20 | 220 | 15 | 400 | 300 | 10 |
| IE | 27 | L | 20 | 220 | 15 | 450 | 300 | 10 |
| IE | 28 | M | 20 | 220 | 15 | 400 | 600 | 10 |
| IE | 29 | N | 20 | 220 | 15 | 400 | 300 | 10 |
| IE | 30 | O | 20 | 180 | 15 | 400 | 300 | 10 |
| IE | 31 | P | 20 | 180 | 15 | 400 | 300 | 10 |
| IE | 32 | Q | 20 | 180 | 15 | 350 | 300 | 10 |
| IE | 33 | R | 20 | 180 | 15 | 400 | 300 | 10 |
| IE | 34 | S | 20 | 180 | 15 | 400 | 600 | 10 |
| IE | 35 | T | 20 | 200 | 15 | 400 | 300 | 10 |
| IE | 36 | U | 20 | 200 | 15 | 400 | 300 | 10 |
| IE | 37 | V | 20 | 200 | 15 | 450 | 300 | 10 |
| IE | 38 | W | 20 | 200 | 15 | 400 | 300 | 10 |
| IE | 39 | X | 20 | 200 | 15 | 400 | 600 | 10 |
| IE | 40 | Y | 20 | 220 | 15 | 400 | 300 | 10 |
| CE | 41 | XA | 20 | 220 | 15 | 400 | 300 | 10 |
| CE | 42 | XB | 20 | 220 | 15 | 400 | 300 | 10 |
| CE | 43 | XC | 20 | 220 | 15 | 400 | 300 | 10 |
| CE | 44 | XD | 20 | 220 | 15 | 400 | 300 | 10 |
| CE | 45 | XE | 20 | 200 | 15 | 400 | 300 | 10 |
| CE | 46 | XF | 20 | 200 | 15 | 400 | 300 | 10 |
| CE | 47 | XG | 20 | 200 | 15 | 400 | 300 | 10 |
| CE | 48 | XH | 20 | 180 | 15 | 400 | 300 | 10 |
| CE | 49 | XI | 20 | 180 | 15 | 400 | 300 | 10 |

1st ACR: first average cooling rate
1st CST: first cooling stop temperature
2nd AHR: second average heating rate
2nd HT: second holding temperature
2nd H-Time: second holding time
2nd ACR: second average cooling rate

TABLE 6

| | No. | Type of Steel | Ferrite (vol %) | Bainite (vol %) | Tempered Martensite (vol %) | Fresh Martensite (vol %) | Retained Austenite (vol %) | Pearlite (vol %) |
|---|---|---|---|---|---|---|---|---|
| IE | 1 | A | 0 | 21 | 56 | 1 | 22 | 0 |
| CE | 2 | A | Poor Pickling | | | | | |
| CE | 3 | A | Fracture occurred during cold rolling | | | | | |
| CE | 4 | A | Poor Pickling | | | | | |
| CE | 5 | A | Fracture occurred during cold rolling | | | | | |
| CE | 6 | A | 33 | 4 | 1 | 0 | 1 | 61 |
| CE | 7 | A | 21 | 8 | 57 | 9 | 5 | 0 |
| CE | 8 | A | 14 | 11 | 58 | 1 | 3 | 13 |
| IE | 9 | B | 0 | 21 | 61 | 0 | 18 | 0 |
| IE | 10 | B | 0 | 16 | 63 | 0 | 21 | 0 |
| IE | 11 | B | 0 | 25 | 55 | 1 | 19 | 0 |
| IE | 12 | C | 0 | 29 | 51 | 2 | 18 | 0 |
| CE | 13 | C | 0 | 2 | 93 | 0 | 5 | 0 |
| CE | 14 | C | 0 | 76 | 4 | 1 | 19 | 0 |
| CE | 15 | C | 0 | 15 | 78 | 2 | 5 | 0 |
| CE | 16 | C | 0 | 24 | 67 | 1 | 8 | 0 |
| CE | 17 | C | 0 | 14 | 77 | 2 | 7 | 0 |
| CE | 18 | C | 0 | 29 | 62 | 4 | 5 | 0 |
| IE | 19 | D | 0 | 22 | 54 | 0 | 24 | 0 |
| IE | 20 | E | 0 | 14 | 68 | 0 | 18 | 0 |
| IE | 21 | F | 0 | 25 | 53 | 1 | 21 | 0 |
| IE | 22 | G | 0 | 41 | 35 | 2 | 22 | 0 |
| IE | 23 | H | 0 | 23 | 51 | 1 | 25 | 0 |
| IE | 24 | I | 0 | 19 | 56 | 1 | 24 | 0 |
| IE | 25 | J | 0 | 21 | 58 | 0 | 21 | 0 |

TABLE 7

| | No. | Type of Steel | Ferrite (vol %) | Bainite (vol %) | Tempered Martensite (vol %) | Fresh Martensite (vol %) | Retained Austenite (vol %) | Pearlite (vol %) |
|---|---|---|---|---|---|---|---|---|
| IE | 26 | K | 0 | 24 | 59 | 0 | 17 | 0 |
| IE | 27 | L | 0 | 15 | 66 | 1 | 18 | 0 |
| IE | 28 | M | 0 | 17 | 63 | 0 | 20 | 0 |
| IE | 29 | N | 0 | 19 | 61 | 1 | 19 | 0 |
| IE | 30 | O | 0 | 29 | 54 | 1 | 16 | 0 |
| IE | 31 | P | 0 | 25 | 55 | 1 | 19 | 0 |
| IE | 32 | Q | 0 | 21 | 57 | 2 | 20 | 0 |
| IE | 33 | R | 0 | 15 | 53 | 0 | 32 | 0 |
| IE | 34 | S | 0 | 26 | 52 | 1 | 21 | 0 |
| IE | 35 | T | 0 | 26 | 56 | 0 | 18 | 0 |
| IE | 36 | U | 0 | 24 | 55 | 2 | 19 | 0 |
| IE | 37 | V | 0 | 21 | 57 | 0 | 22 | 0 |
| IE | 38 | W | 0 | 20 | 59 | 0 | 21 | 0 |
| IE | 39 | X | 0 | 25 | 55 | 0 | 20 | 0 |
| IE | 40 | Y | 0 | 23 | 58 | 1 | 18 | 0 |
| CE | 41 | XA | 0 | 18 | 71 | 0 | 11 | 0 |
| CE | 42 | XB | 0 | 16 | 24 | 14 | 46 | 0 |
| CE | 43 | XC | 0 | 29 | 69 | 1 | 1 | 0 |
| CE | 44 | XD | 0 | 15 | 41 | 23 | 21 | 0 |
| CE | 45 | XE | 0 | 22 | 43 | 18 | 17 | 0 |
| CE | 46 | XF | 0 | 24 | 63 | 0 | 6 | 7 |
| CE | 47 | XG | 0 | 12 | 50 | 15 | 23 | 0 |
| CE | 48 | XH | 0 | 17 | 47 | 21 | 15 | 0 |
| CE | 49 | XI | 0 | 15 | 55 | 16 | 14 | 0 |

TABLE 8

| | No. | Type of Steel | [Si + Al]γ/ [Si + Al]av | TSXEL (MPa %) | R/t |
|---|---|---|---|---|---|
| IE | 1 | A | 0.72 | 30256 | 1.69 |
| CE | 2 | A | Poor Pickling | | |
| CE | 3 | A | Fracture occurred during cold rolling | | |
| CE | 4 | A | Poor Pickling | | |
| CE | 5 | A | Fracture occurred during cold rolling | | |
| CE | 6 | A | 0.95 | 13538 | 1.75 |
| CE | 7 | A | 0.97 | 28104 | 4.82 |

TABLE 8-continued

| | No. | Type of Steel | [Si + Al]γ/ [Si + Al]av | TSXEL (MPa %) | R/t |
|---|---|---|---|---|---|
| CE | 8 | A | 0.93 | 21462 | 2.51 |
| IE | 9 | B | 0.73 | 29810 | 1.85 |
| IE | 10 | B | 0.58 | 32553 | 1.92 |
| IE | 11 | B | 0.72 | 27127 | 1.85 |
| IE | 12 | C | 0.74 | 31541 | 2.14 |
| CE | 13 | C | 0.92 | 17943 | 6.47 |
| CE | 14 | C | 0.81 | 21683 | 2.75 |

TABLE 8-continued

| | No. | Type of Steel | [Si + Al]γ/[Si + Al]av | TSXEL (MPa %) | R/t |
|---|---|---|---|---|---|
| CE | 15 | C | 0.97 | 11670 | 8.66 |
| CE | 16 | C | 0.98 | 20042 | 2.51 |
| CE | 17 | C | 0.95 | 18260 | 8.24 |
| CE | 18 | C | 0.96 | 21710 | 2.87 |
| IE | 19 | D | 0.75 | 24756 | 2.38 |
| IE | 20 | E | 0.78 | 32313 | 1.82 |
| IE | 21 | F | 0.82 | 30930 | 1.76 |
| IE | 22 | G | 0.72 | 27759 | 2.83 |
| IE | 23 | H | 0.71 | 24848 | 2.05 |
| IE | 24 | I | 0.76 | 28798 | 2.34 |
| IE | 25 | J | 0.78 | 25693 | 1.78 |

TABLE 9

| | No. | Type of Steel | [Si + Al]γ/[Si + Al]av | TSXEL (MPa %) | R/t |
|---|---|---|---|---|---|
| IE | 26 | K | 0.72 | 31068 | 1.92 |
| IE | 27 | L | 0.75 | 28688 | 2.74 |
| IE | 28 | M | 0.71 | 24300 | 2.31 |
| IE | 29 | N | 0.73 | 27092 | 2.06 |
| IE | 30 | O | 0.70 | 27887 | 1.88 |
| IE | 31 | P | 0.73 | 28081 | 1.96 |
| IE | 32 | Q | 0.74 | 26951 | 2.05 |
| IE | 33 | R | 0.78 | 32038 | 2.81 |
| IE | 34 | S | 0.72 | 29157 | 2.55 |
| IE | 35 | T | 0.77 | 31343 | 2.53 |
| IE | 36 | U | 0.76 | 24827 | 2.68 |
| IE | 37 | V | 0.81 | 28597 | 2.07 |
| IE | 38 | W | 0.73 | 25430 | 2.46 |
| IE | 39 | X | 0.72 | 30264 | 2.15 |
| IE | 40 | Y | 0.72 | 31544 | 1.68 |
| CE | 41 | XA | 0.83 | 19694 | 2.41 |
| CE | 42 | XB | 0.68 | 20871 | 8.47 |
| CE | 43 | XC | 0.96 | 10522 | 4.28 |
| CE | 44 | XD | 0.71 | 28005 | 7.25 |
| CE | 45 | XE | 0.73 | 27513 | 6.86 |
| CE | 46 | XF | 0.94 | 15532 | 2.83 |
| CE | 47 | XG | 0.69 | 23164 | 6.37 |
| CE | 48 | XH | 0.78 | 22831 | 5.49 |
| CE | 49 | XI | 0.77 | 22334 | 5.31 |

From Tables 1 to 9, it was confirmed that in each of Inventive Examples satisfying conditions proposed in the present disclosure, a value of [Si+Al]γ/[Si+Al]av was within the range of 0.55 to 0.85, TS×El was 22,000 MPa % or more, R/t was within the range of 0.5 to 3.0, and strength was excellent, and ductility and workability were excellent.

It was confirmed that in Comparative Examples 2 to 5, alloy composition ranges overlapped the alloy composition range of the present disclosure, but hot-rolling annealing temperature and time after hot rolling were outside the range proposed in the present disclosure, so that poor pickling occurred or fracture occurred during cold rolling.

In Comparative Example 6, a first heating or holding temperature during an annealing heat treatment after cold rolling was low, so that ferrite was excessively formed and fractions of bainite and tempered martensite were insufficient. As a result, [Si+Al]γ/[Si+Al]av was greater than 0.85 and TS×El was less than 22,000 MPa %. In Comparative Example 7, a first holding time was short to result in non-uniformity of a structure, so that a ferrite fraction was excessively formed and fractions of bainite and retained austenite were insufficient. As a result, [Si+Al]γ/[Si+Al]av was greater than 0.85 and R/t was greater than 3.0. In Comparative Example 8, a first cooling rate was low, so that ferrite was excessively formed and a retained austenite fraction was insufficient. As a result, [Si+Al]γ/[Si+Al]av was greater than 0.85, and TS×El was less than 22,000 MPa %.

In Comparative Example 13, a first cooling stop temperature was low, so that tempered martensite was excessively formed and a retained martensite fraction was insufficient. As a result, [Si+Al]γ/[Si+Al]av was greater than 0.85, TS×El was less than 22,000 MPa %, and R/t was greater than 3.0. In Comparative Example 14, a first cooling stop temperature was higher than that proposed in the present disclosure, so that bainite was excessively formed and formation of tempered martensite was insufficient. As a result, TS×El was less than 22,000 MPa %.

In Comparative Examples 15 and 16 in which a second heating or holding temperature was low or high, retained austenite was not formed in an appropriate range. As a result, [Si+Al]γ/[Si+Al]av was greater than 0.85 and TS×El was less than 22,000 MPa %. In particular, in Comparative Example 15, tempered martensite was also excessively formed, so that R/t was greater than 3.0.

In Comparative Examples 17 and 18, a second holding time was insufficient or excessive. In Comparative Examples 17, tempered martensite was excessively formed and retained austenite was insufficient, so that [Si+Al]γ/[Si+Al]av was greater than 0.85, TS×El was less than 22,000 MPa %, and R/t was greater than 3.0. In Comparative Example 18, retained austenite was insufficient, so that [Si+Al]γ/[Si+Al]av was greater than 0.85, and TS×El was less than 22,000 MPa %.

Comparative Examples of 41 to 49, satisfying the manufacturing conditions proposed in the present disclosure, but were outside an alloy composition range, did not satisfy all conditions of [Si+Al]γ/[Si+Al]av, TS×El, and R/t of the present disclosure. Comparative Example 43, in which the sum of silicon and aluminum (Si+Al) was less than 1.0% in the alloy composition of the present disclosure, did not satisfy all conditions of [Si+Al]γ/[Si+Al]av, TS×El, and R/t.

The invention claimed is:

1. A steel sheet comprising; by weight %, carbon (C): more than 0.25% to 0.75%, silicon (Si): 4.0% or less, manganese (Mn): 0.9 to 5.0%, aluminum (Al): 5.0% or less, phosphorus (P): 0.15% or less, sulfur (S): 0.03% or less, nitrogen (N): 0.03% or less, and a balance of iron (Fe) and inevitable impurities; anda microstructure comprises, by volume %, 30-75% of tempered martensite, 10 to 50% of bainite, 10 to 40% of retained austenite, 5% or less of ferrite, and an inevitable structure, and satisfying the following Relational Expression 1, $$0.55 \leq [Si+Al]\gamma/[Si+Al]av \leq 0.85, \quad \text{[Relational Expression 1]}$$

where [Si+Al]γ is a content (weight %) of Si and Al contained in the retained austenite, and [Si+Al]av is a content (weight %) of Si and Al contained in the high-strength steel sheet, wherein R/t is 0.5 to 3.0 where R is a minimum bending radius (mm) at which cracking does not occur after a 900 bending test and t is a thickness (mm) of the steel sheet.

2. The high-strength steel sheet of claim 1, further comprising at least one of (1) to (9):

(1) at least one of titanium (Ti): 0 to 0.5%, niobium (Nb): 0 to 0.5%, and vanadium (V): 0 to 0.5%;

(2) at least one of chromium (Cr): 0 to 3.0% and molybdenum (Mo): 0 to 3.0%;

(3) at least one of copper (Cu): 0 to 4.5% and nickel (Ni): 0 to 4.5%;

(4) boron (B): 0 to 0.005%;

(5) at least one of calcium (Ca): 0 to 0.05%, a rare earth element (REM) except yttrium (Y): 0 to 0.05%, and magnesium (Mg): 0 to 0.05%;

(6) at least one of tungsten (W): 0 to 0.5% and zirconium (Zr): 0 to 0.5%;

(7) at least one of antimony (Sb): 0 to 0.5% and tin (Sn): 0 to 0.5%;

(8) at least one of yttrium (Y): 0 to 0.2% and hafnium (Hf): 0 to 0.2%; and (9) cobalt (Co): 0 to 1.5%.

3. The high-strength steel sheet of claim 1, wherein a sum of silicon and aluminum (Si+Al) is 1.0 to 6.0%.

4. The steel sheet of claim 1, wherein a product of tensile strength and elongation (TS×El) is 22,000 MPa % or more.

5. A method of manufacturing the steel sheet of claim 1, the method comprising: heating a steel slab and hot rolling the heated steel slab to obtain a hot-rolled steel sheet, the steel slab comprising, by weight %, carbon (C): more than 0.25% to 0.75%, silicon (Si): 4.0% or less, manganese (Mn): 0.9 to 5.0%, aluminum (Al): 5.0% or less, phosphorus (P): 0.15% or less, sulfur (S): 0.03% or less, nitrogen (N): 0.03% or less, and a balance of iron (Fe) and inevitable impurities; coiling the hot-rolled steel sheet; performing a hot-rolling annealing heat treatment on the coiled steel sheet in a temperature range of 650 to 850° C. for 600 to 1700 seconds; cold rolling the coiled steel sheet subjected to the hot-rolling annealing heat treatment; heating the cold-rolled steel sheet to Ac3 or higher (first heating) and holding the first-heated steel sheet for 50 seconds or more (first holding); cooling the first-heated steel sheet to a temperature range of 100 to 300° C. at an average cooling rate of 1° C./sec (first cooling); heating the first-cooled steel sheet to a temperature range of 300 to 500° C. (second heating) and holding the second-heated steel sheet in the temperature range of 300 to 500° C. for 50 seconds or more (second holding); and cooling the second-heated steel sheet to room temperature; thereby producing the steel sheet of claim 1.

6. The method of claim 5, wherein the cold-rolled steel sheet further comprises at least one of (1) to (9):

(1) at least one of titanium (Ti): 0 to 0.5%, niobium (Nb): 0 to 0.5%, and vanadium (V): 0 to 0.5%;

(2) at least one of chromium (Cr): 0 to 3.0% and molybdenum (Mo): 0 to 3.0%;

(3) at least one of copper (Cu): 0 to 4.5% and nickel (Ni): 0 to 4.5%;

(4) boron (B): 0 to 0.005%;

(5) at least one of calcium (Ca): 0 to 0.05%, a rare earth element (REM) except yttrium (Y): 0 to 0.05%, and magnesium (Mg): 0 to 0.05%;

(6) at least one of tungsten (W): 0 to 0.5% and zirconium (Zr): 0 to 0.5%;

(7) at least one of antimony (Sb): 0 to 0.5% and tin (Sn): 0 to 0.5%;

(8) at least one of yttrium (Y): 0 to 0.2% and hafnium (Hf): 0 to 0.2%;

(9) cobalt (Co): 0 to 1.5%.

7. The method of claim 5, wherein the steel slab is heated to a temperature in a range of 1000 to 1350° C., and hot rolling comprises performing finish hot rolling in a temperature range of 800 to 1000° C.

8. The method of claim 5, wherein the coiling is performed in a temperature range of 300 to 600° C.

9. The method of claim 5, wherein the cold rolling is performed at a reduction ratio of 30 to 90%.

10. The method of claim 5, wherein a rate of the second heating is 5° C./sec or more.

11. The method of claim 5, wherein a rate of the second cooling is 1° C./sec or more.

* * * * *